US005618620A

United States Patent [19]

Takegawa et al.

[11] Patent Number: 5,618,620

[45] Date of Patent: *Apr. 8, 1997

[54] FILTER ROD FOR FILTERING THE SMOKE OF A CIGARETTE

[75] Inventors: Masaharu Takegawa, Osaka; Akihisa Matsuda, deceased, late of Osaka, both of Japan, by Yoshitaka Matsuda, heir

[73] Assignee: Daicel Chemical Industries, Ltd., Osaka, Japan

[ * ] Notice: The term of this patent shall not extend beyond the expiration date of Pat. No. 5,225,277.

[21] Appl. No.: 443,821

[22] Filed: May 18, 1995

Related U.S. Application Data

[60] Continuation of Ser. No. 967,751, Oct. 28, 1992, abandoned, which is a division of Ser. No. 614,206, Nov. 16, 1990, Pat. No. 5,225,277.

[51] Int. Cl.[6] ..... D02G 3/00; A24D 3/06

[52] U.S. Cl. ..... 428/339; 428/362; 428/369; 131/342; 131/345

[58] Field of Search ..... 428/339, 362, 428/369; 131/342, 345

[56] References Cited

U.S. PATENT DOCUMENTS

| | | | |
|---|---|---|---|
| 2,794,239 | 6/1957 | Crawford et al. | 206/59 |
| 2,953,838 | 9/1960 | Crawford et al. | 28/81 |
| 3,078,542 | 2/1963 | McFarren et al. | 28/72 |
| 3,079,663 | 3/1963 | Dyer et al. | 28/1 |
| 4,180,536 | 12/1979 | Howell et al. | 131/345 |
| 4,283,186 | 8/1981 | Keith et al. | 131/345 |

*Primary Examiner* Thurman K. Page
*Assistant Examiner*—Kathryne E. Shelborne
*Attorney, Agent, or Firm* McAulay Fisher Nissen Goldberg & Kiel, LLP

[57] ABSTRACT

A filter rod for filtering the smoke of a cigarette including an acetate tow having a high crimp modulus and the acetate tow is bloomed and wrapped by a paper to form the filter rod, wherein a degree of crimping of the acetate tow at a position just downstream of a delivery roller of a filter rod making machine used to form a filter rod is 1.4 or more, and is obtained by conditions satisfying the following equations by having the crimping operation performed under the conditions satisfying the following equations (1) and (2):

$$2 \leq A \leq 17 \quad (1)$$

$$-\frac{2}{3}A + \frac{136}{3} \leq T \leq \frac{2}{3}A + \frac{169}{3} \quad (2)$$

wherein:

A stands for the weight percent of acetone of the acetate tow just after the tow is fed from a stuffing box type crimping apparatus; and T stands for a temperature of the acetate tow just after the tow is fed from the stuffing box type crimping machine.

10 Claims, 1 Drawing Sheet

FILTER ROD FOR FILTERING THE SMOKE OF A CIGARETTE

This is a continuation of application Ser. No. 07/967,751, filed Oct. 28, 1992, now abandoned, which is a division of application Ser. No. 07/614,206, filed Nov. 16, 1990, now U.S. Pat. No. 5,225,277.

BACKGROUND OF THE INVENTION

1. Field of the Invention

This invention relates to a novel acetate tow in a filter rod used to filter a smoke of a cigarette, and a method of manufacturing same. More particularly, this invention relates to an acetate tow having a high crimp modulus and having no a tendency which the acetate tow is caught on a feed roller of a filter rod making machine when the machine is operated.

2. Description of the Related Art

It is well known that the purpose of a cigarette filter is to reduce an influence on human health of smoking a cigarette, and that an acetate tow is mainly used as the conventional cigarette filter, i.e., as a filler in a filter rod used to filter the smoke of a cigarette. As is also well known, when the acetate tow is used to filter the smoke of the cigarette, the acetate tow uniformly collects whole components of the smoke but the taste of the filtered smoke remains good. To make the filter rod by using a filter rod making machine, the acetate tow is first bloomed, and the bloomed tow is wrapped in paper to form a filter.

FIG. 2 shows an example of a filter rod making machine 10 currently in wide use for making the filter. In FIG. 2, 1 is an acetate tow fed to the filter rod making machine 10, 2 a pair of pretensioning rollers, 3 a pair of feed rollers, 4 a pair of delivery rollers, 5 a wrapping paper, 6 a rod making device, and 7 a knife. Although only one pair of feed rollers 3 is used in the filter rod making machine illustrated in FIG. 1, two pairs of feed rollers may be used.

The acetate tow 1 is applied with a stretch force of between 1.4 and 2.5, by one or two operations, in an area between the pair of pretensioning rollers 2 and the pairs of feed rollers 3, and then relaxation is allowed in the acetate tow between the pair of feed rollers 3 and the pair of delivery rollers 4, to bloom the acetate tow 1. The high stretching force applied during the tow stretch treatment cause a complete removal of a part of crimps in the acetate tow, and therefore, when the filter rod is formed by wrapping the thus bloomed acetate tow with paper, the pressure drop of the air for the filter rod becomes too low, and further, a filtration efficiency of the smoke becomes too low. To solve the above problem, it has been proposed that a degree of relaxation of the acetate tow 1 be made larger, in such a manner that a large recovery of the crimp of the acetate tow after the stretching treatment is realized, to raise the pressure drop for the filter rod, but in this case, the acetate tow has a tendency to be caught on the feed rollers of the filter rod making machine, and thus production of the filter rod becomes difficult in practice.

Japanese Unexamined Patent Publication (Kokai) No. 56-53233, for example, proposed to method in which the acetate tow is treated, at a position upstream of a stuffing box type crimping apparatus, with a steam to make the Young's modulus of the acetate tow higher or to make the number of crimps in the acetate tow larger. In the above method, however, an irregular crimp often generated due to fluctuations of the temperature of the steam, and further, this method has problems such that when the temperature of the steam becomes slightly lower than the predetermined temperature, an improvement of the Young's modulus cannot be obtained, and when the temperature of the steam becomes slightly higher than the predetermined temperature, the fibers in the acetate tow adhere to each other.

SUMMARY OF THE INVENTION

Therefore, a primary object of the present invention is to provide an acetate tow having a high crimp modulus which enables an almost complete recovery of a crimp when the acetate tow is treated in a filter rod making machine, and which does not cause a tendency which the acetate tow is caught on a roller.

A second object of the present invention is to provide a method of manufacturing such an acetate tow having the above characteristics.

The primary object of the present invention is obtained by providing an acetate tow having a high crimp modulus, wherein a degree of crimping of the acetate tow at a position just downstream of a delivery roller of a filter rod making machine is 1.4 or more.

The method of manufacturing the acetate tow having the high crimp modulus in accordance with the present invention is characterized in that the acetate tow is applied with a crimp in a stuffing box type crimping apparatus, and the crimping operation is performed under conditions satisfying the following equations (1) and (2).

$$2 \leq A \leq 17 \quad (1)$$

$$-\frac{2}{3}A+\frac{136}{3} \leq T \leq -\frac{2}{3}A+\frac{16}{3} \quad (2)$$

wherein:

A stands for a content of an acetone of the acetate tow just after the tow is fed from the stuffing box type crimping apparatus; and T stands for a temperature of the acetate tow just after the tow is fed from the stuffing box type crimping machine.

DESCRIPTION OF THE PREFERRED EMBODIMENT

Figure 1:
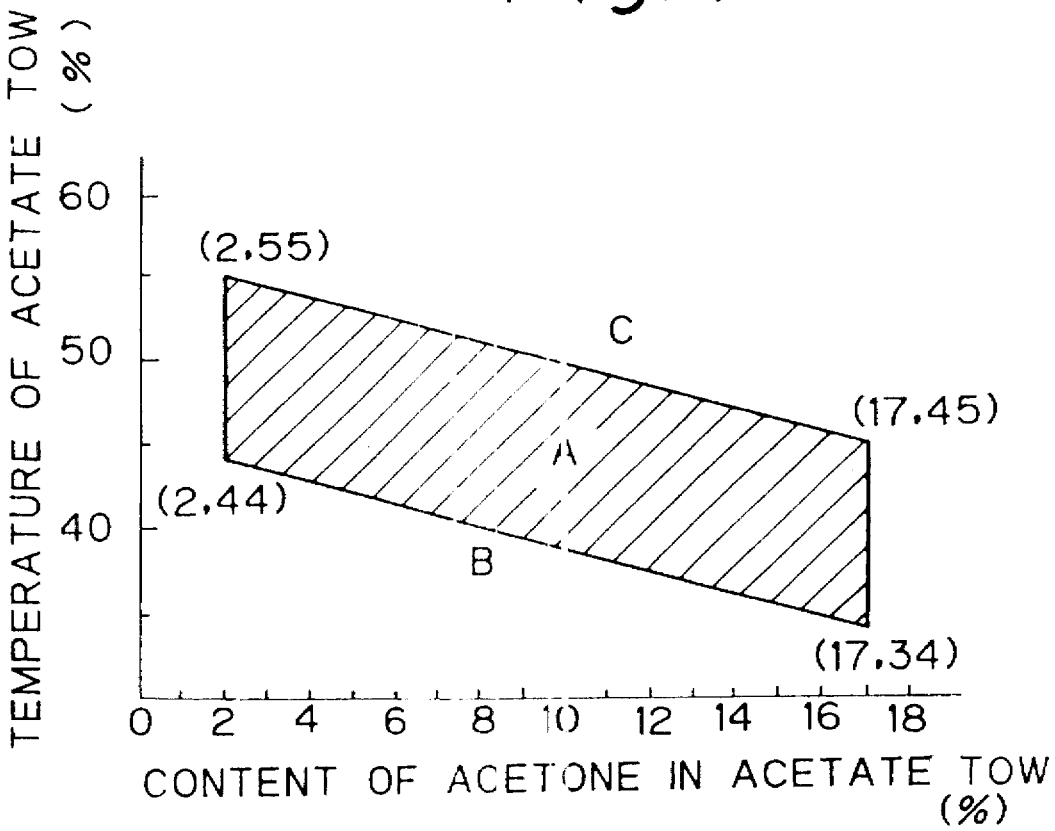
FIG. 1 is a graph illustrating an area having a preferable relationship between a content (%) of acetone in a acetate tow and a temperature (°C.) of the acetate tow just after the tow is fed from the stuffing box type crimping apparatus.
Figure 2:
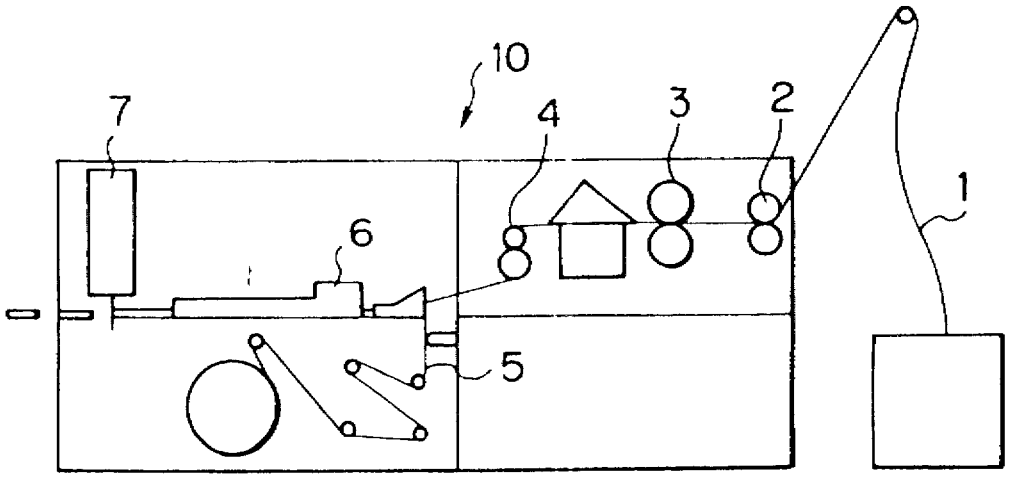
FIG. 2 is a view illustrating a filter rod making machine used to wrap the acetate tow with paper to form a filter body.

The present invention will now be described in detail with reference to the accompanying drawings illustrating an example of preferable manufacturing conditions in accordance with the present invention.

A main component of the acetate tow used in the present invention is a cellulose acetate, and this cellulose acetate is obtained by esterifying a cellulose with an acetic anhydride. Preferably, a cellulose acetate having a polymerization degree of between 100 and 500 and degree of acetylation of between 40% and 62.5% as a combined acetic acid is used, but a cellulose acetate having a lower polymerization degree may be used.

The acetate tow is obtained by a dry spinning method in which the cellulose acetate is dissolved in an acetone, and the dissolved material is extruded through a spinneret to obtain a multifilament constituted by a plurality of monofilaments. Thereafter, the plurality of multifilaments are gathered, to form a tow, and a crimp is applied to the tow by a stuffing box type crimping machine. In the present invention, an acetate tow having a total denier of between 10,000 denier and 100,000 denier is used, and a denier of a monofilament constituting the acetate tow is between 1 denier and 15 denier, and further, a number of crimps of between 15 per inch and 50 per inch is generally used. Note, the acetate tow produced in accordance with the present invention is not limited to the above ranges.

A degree of crimping of the acetate tow of the present invention is a degree of crimping of the acetate tow obtained at a position Just downstream of a delivery roller of a filter rod making machine. Namely since this degree of crimping of the acetate tow is that obtained during the process of manufacturing a filter rod, it is impossible to use a conventional method of measuring the degree of crimping. Accordingly, the degree of crimping of the acetate tow is obtained by the following equations $$\text{Degree of crimping of filter body} = \frac{\text{Weight (g) of a tow in filter rod}}{\text{Length of a filter rod} \times \text{Total denier of a tow}} \times 9000 \quad (3)$$

$$\text{Degree of crimping of a tow} = \text{Degree of crimping of a filter body} \times \frac{\text{Wrapping paper speed of a tow in a filter rod making machine}}{\text{Linear velocity of a delivery roller}} \quad (4)$$

As described above, the acetate tow of the present invention is characterized in that a degree of crimping measured at a position Just downstream of a delivery roller of a filter rod making machine is 1.4 or more. When an acetate tow having a degree of crimping of less than 1.4 is used, and a ratio of a linear velocity of a feed roller to a linear velocity of a pretensioning roller is raised, for example, to 1.6, to provide a good blooming of the acetate tow in the filter rod making machine, a pressure drop for a filter rod made from the acetate tow becomes too low, and when a ratio of the linear velocity of a delivery roller to the linear velocity of the feed roller is lowered, for example, to 0.6, to increase the pressure drop for the filter rod, the tendency which the acetate tow is caught on the feed roller becomes larger, and thus a practical production of the filter body becomes impossible. Accordingly it is practically impossible to greatly decrease the ratio of the linear velocity of the delivery roller to the linear velocity of the feed roller, and an increase of the pressure drop in the filtering rod cannot be obtained when the degree of crimping of the acetate tow is less than 1.4.

Accordingly, the degree of crimping must be made 1.4 or more, to obtain a filter body having a required pressure drop and to eliminate the tendency which the acetate tow is caught on the feed roller.

A preferable method of manufacturing an acetate tow in accordance with the present invention is characterized in that the acetate tow is applied with a crimp by a stuffing box type crimping apparatus, and the crimping treatment is performed under conditions satisfying the above-mentioned equations (1) and (2).

A heat treatment satisfying the above-mentioned equation (2) may be applied to the acetate tow at a position upstream of the stuffing box type crimping machine, or while the tow is in the stuffing box type crimping machine.

An example of a preferable condition satisfying the above-mentioned equations (1) and (2) is illustrated in the graph shown in FIG. 1. In FIG. 1, a temperature (°C.) of the acetate tow is shown as an ordinate, and a content of an acetone in the acetate tow is shown as the abscissa. The shaded area A in FIG. 1 shows the range of manufacturing conditions in accordance with the present invention. The content of acetone in the acetate tow depends on another manufacturing condition used in the process of manufacturing the acetate tow. Further a preferable temperature at which the acetate tow is heated depends on the content of the acetone in the acetate tow. Namely, when the content of the acetone is high, the acetate tow becomes too soft. Accordingly, the temperature at which the acetate tow is heated must be lowered in accordance with an increase of the acetone content. If this requirement is not satisfied, an adhesion between the fibers in the acetate tow will be generated. Therefore, the area A in FIG. 1 showing the conditions required for the present invention is inclined downward and to the right in the Figure.

The area B in FIG. 1 shows an area encompassing the conditions used in a conventional method of manufacturing the acetate tow. When using the manufacturing conditions within the area B, it is impossible to manufacture an acetate tow having a high crimp modulus. Namely, when manufacturing a filter body by using the acetate tow obtained under the conditions of area B, a recovery of the crimp is too small and a tendency which the acetate tow is caught on a feed roller is too large, and thus it is impossible to obtain the filter body having a high pressure drop.

When the acetate tow is manufactured under manufacturing conditions within the area C in FIG. 1, the temperature of the acetate tow becomes too high, which results in the generation of an adhesion between the fibers in the acetate tow. Therefore, when the acetate tow is treated on a filter rod making machine, the blooming of the acetate tow is not enough and thus the pressure drop of the filter body becomes too low.

The acetone content in the acetate tow can be controlled in a dry spinning process. Namely, a dope extruded from a spinneret is evaporated in a spinning tube into which a hot air is blown to form a solid fiber, and accordingly, the acetone content can be maintained at the predetermined value by suitably changing a take up speed of an acetate filament and a temperature and/or a volume of the hot air blown thereover.

The temperature of the acetate tow can be controlled by heating the acetate tow at a position upstream of the stuffing box type crimping machine, or while the tow is in the stuffing box type crimping machine. In the former case, a method of heating by a heated roller, a method of applying a heated liquid, with or without a textile oil agent, and a method of heating with a steam or the like, can be used.

As described above, the acetate tow of the present invention has remarkable features such that a tendency which the acetate tow is caught on a feed roller is very low when forming the filter rod in a filter rod making machine, and when a filter rod is formed of the acetate tow, a filter rod having a very high pressure drop can be obtained.

Further it is possible to easily obtain an acetate tow having a high crimp modulus, by using the manufacturing method in accordance with the present invention.

EXAMPLES

The present invention is further described in detail with reference to examples of the present invention and comparative examples. It is understood that the present invention is not limited by the following examples.

Example 1

A monofilament having a denier of 3 and a Y-shape cross section was manufactured by a dry spinning method. During this process, a temperature of an air blown into a spinning tube was 100° C. and a take up speed of the monofilament was 400 m/min. Then 12,000 monofilaments were collected to obtain an acetate tow having a total denier of 36,000, and the obtained acetate tow was fed into a stuffing box type crimping machine to form an acetate tow having a number of crimps of 30 per inch. Water heated to 70° C. and containing a textile oil agent was applied to the acetate tow at a position upstream of the stuffing box type crimping machine. The aceton content of acetate tow at a position downstream of the stuffing box type crimping machine was 8 wt % and the temperature of the acetate tow when measured at the same position was 50° C. The temperature was measured by a non-contact type infrared thermometer.

A filter rod having a circumference of 24.8 mm and a length of 120 mm, was prepared from the obtained acetate tow, by a filter rod making machine KDF2/AF1 supplied by Körber AG, Hauni-Werke. First, a ratio of a linear velocity of a feed roller to a pretension roller was set to 1.6 and then a relaxation in the tow between the feed roller and a delivery roller was increased by lowering a ratio of the linear velocity of a delivery roller to that of the feed roller so that the acetate tow was caught on the feed roller. In this test, a degree of crimping of the acetate tow at a position just downstream of the delivery roller, and Just before the acetate tow was caught on the feed roller, was 1.45. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.640 g per a filter rod was 325 mm as a height of a water column.

This value was higher than values of pressure drops of filter rods obtained from acetate tows manufactured under conditions in the following comparative examples.

Comparative Example 1

An acetate tow having a total denier of 36,000, a denier of a monofilament thereof being 3 denier, and manufactured under the same conditions as those used in Example 1 was fed into the stuffing box type crimping machine to obtain a crimped tow. The acetone content of the acetate tow taken at a position downstream of the stuffing box type crimping machine was 8 wt %, and a temperature of the acetate tow measured at the same position was 38° C.

A filter rod having a circumference of 24.8 mm and a length of 120 mm was prepared from the obtained acetate tow by the same filter rod making machine as that used in Example 1. The same test as that used in Example 1 was performed, and a degree of crimping of the acetate tow at the position just downstream of the delivery roller and just before the acetate tow was caught on the feed roller was 1.35. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.640 g per a filter rod was 304 mm as a height of a water column.

Comparative Example 2

An acetate tow having a total denier of 36,000, a denier of a monofilament thereof which being 3 denier, and manufactured under the same conditions as those used in Example 1 was fed through a steam heating type apparatus having a temperature of 110° C. and into the stuffing box type crimping machine, to obtain a crimped tow. The acetone content of the acetate tow taken at a position downstream of the stuffing box type crimping machine was 7 wt %, and a temperature of the acetate tow measured at the same position was 55° C.

The obtained acetate tow contained portions in which the fibers were cohered to each other. A filter rod having a circumference of 24.8 mm and a length of 120 mm was prepared from the obtained acetate tow by the same filter red making machine as that used in Example 1. The same test as that used in Example 1 was performed, and a degree of crimping of the acetate tow at the position just downstream of the delivery roller and Just before the acetate tow was caught on the feed roller was 1.37. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.640 g per a filter rod was 295 mm as a height of a water column.

Example 2

A monofilament having a denier of 4 and a Y-shape cross section was manufactured by a dry spinning method, and then an acetate tow having a total denier of 40,000 was manufactured under the same and other conditions as those used in Example 1. This acetate tow was fed through the steam heating type apparatus having a temperature of 110° C. and into the stuffing box type crimping machine, to obtain a crimped tow having a number of crimps of 30 per inch. The acetone content of the acetate tow taken at a position downstream of the stuffing box type crimping machine was 11 wt %, and a temperature of the acetate tow measured at the same position was 43° C.

The same test as that used in Example 1 was performed, and a degree of crimping of the acetate tow at the position just downstream of the delivery roller and just before the acetate tow was caught on the feed roller was 1.43. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.640 g per a filter rod was 345 mm as a height of a water column.

The value of the pressure drop in this Example showed the usefulness of the filter rod using the acetate tow constituted by monofilaments having a Y shape cross section and a denier of 4.

Example 3

An acetate tow having a total denier of 40,000, a denier of a monofilament thereof being 4, was manufactured under the same manufacturing condition as those used in Example 2, except that a temperature of the air blown into the spinning tube was 110° C. The obtained acetate tow was fed into a stuffing box type crimping machine having a tow compacting roller heated at 80° C., to obtain a crimped tow having a number of crimps of 30 per inch. The acetone content of the acetate tow taken at a position downstream of the stuffing box type crimping machine was 4 wt % and a temperature of the acetate tow measured at the same position was 53° C.

The same test as that used in Example 1 was performed, and a degree of crimping of the acetate tow at the position just downstream of the delivery roller and just before the acetate tow was caught on the feed roller was 1.47. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.740 g per a filter rod was 348 mm as a height of a water column.

Example 4

An acetate tow having a total denier of 40,000, a denier of a monofilament thereof being 4, was manufactured under the same manufacturing condition as those used in Example 2, except that a temperature of the air blown into the spinning tube was 95° C. The obtained acetate tow was fed into a stuffing box type crimping machine having a tow compacting roller heated at 70° C., to obtain a crimped tow having a number of crimps of 30 per inch. The acetone content of the acetate tow taken at a position downstream of the stuffing box type crimping machine was 15 wt % and a temperature of the acetate tow measured at the same position was 38° C.

The same test as that used in Example 1 is performed, and a degree of crimping of the acetate tow at the position just downstream of the delivery roller and just before the acetate tow was caught on the feed roller was 1.42. Further, when the ratio of the linear velocity of the feed roller to the pretension roller was set to 1.6 and then the ratio of the linear velocity of the delivery roller to that of the feed roller was increased to a ratio at which there ware no variations of a width of the acetate two and the acetate tow was smoothly running between the feed roller and the delivery roller, a pressure drop of a obtained filter rod at a compaction of the tow of 0.740 g per a filter rod was 344 mm as a height of a water column.

We claim:

1. A filter rod for filtering the smoke of a cigarette, comprising: an acetate tow obtained by a dry spinning method in which cellulose acetate is dissolved in acetone and in which the acetate tow is bloomed and wrapped by a paper to the filter rod, wherein the acetate tow has a high crimp modulus, and wherein a degree of crimping of the acetate tow at a position just downstream of a delivery roller of a filter rod making machine is as low as at least 1.4 and is obtained by conditions satisfying the following equations by having the crimping operation performed under the conditions satisfying the following equations (1) and (2):

$$2 \leqq A \leqq 17 \quad (1)$$

$$-\frac{2}{3}A + \frac{136}{3} \leqq T \leqq \frac{2}{3}A + \frac{169}{3} \quad (2)$$

wherein:

A stands for the weight percent of acetone of the acetate tow just after the tow is fed from a stuffing box crimping apparatus; and T stands for a temperature of the acetate tow just after the tow is fed from the stuffing box crimping machine; and wherein conditions satisfying equations (1) and (2) are represented by the shaded A in FIG. 1, with a temperature in degrees centigrade of acetate tow is used as an ordinate and the weight percent of acetone in the acetate tow is used as an abscissa, the content of acetone in the acetate falls within a range of 2.44 to 17.34 in a horizontal or abscissa direction and 2.55 to 17.45 in the vertical or ordinate direction, with the first number designating the weight percent of acetone in the acetate tow in percentage and the second number representing the temperature in degrees centigrade of the acetate tow, to obtain a filter body having a required pressure drop and to eliminate the tendency with which the acetate tow is caught on a feed roller of the filter rod making machine.

2. The filter rod according to claim 1, wherein the total denier of the acetate tow is between 10,000 d and 100,000 d.

3. The filter rod according to claim 1, wherein the denier of a monofilament constituting the acetate tow is between 1 d and 15 d.

4. The filter rod according to claim 1, wherein the number of crimps therein is between 15 per 1 inch and 50 per 1 inch.

5. The filter rod according to claim 2, wherein the denier of a monofilament constituting the acetate tow is between 1 d and 15 d.

6. The filter rod according to claim 2, wherein the number of crimps therein is between 15 per 1 inch and 50 per 1 inch.

7. A filter rod according to claim 1, wherein the cellulose acetate has a polymerization degree between 100 and 500, and a degree of acetylation of between 40% and 62.5% as a combined acetic acid.

8. The filter rod according to claim 1, wherein the degree of crimping of the acetate tow at the positions just downstream of the delivery roller is between 1.4 and 2.5 and is obtained by two stretch operations in pre-tensioning rollers and a pair of feed rollers and relaxation is allowed in the acetate tow between the pair of feed rollers and the pair of delivery rollers.

9. The filter rod according to claim 1, including the step of applying heat treatment to the acetate tow at a position upstream of the stuffing box crimping machine.

10. The filter rod according to claim 1, including the step of applying heat treatment to the acetate tow while the acetate tow is in the stuffing box crimping machine.

* * * * *